US006859177B2

(12) United States Patent
Pozdeev

(10) Patent No.: US 6,859,177 B2
(45) Date of Patent: Feb. 22, 2005

(54) FOUR PORT HYBRID MICROSTRIP CIRCUIT OF LANGE TYPE

(75) Inventor: Oleg Pozdeev, Akersberga (SE)

(73) Assignee: Allgon AB, Taby (SE)

( * ) Notice: Subject to any disclaimer, the term of this patent is extended or adjusted under 35 U.S.C. 154(b) by 49 days.

(21) Appl. No.: 10/432,617

(22) PCT Filed: Nov. 9, 2001

(86) PCT No.: PCT/SE01/02489

§ 371 (c)(1),
(2), (4) Date: Jun. 5, 2003

(87) PCT Pub. No.: WO02/052675

PCT Pub. Date: Jul. 4, 2002

(65) Prior Publication Data

US 2004/0061571 A1 Apr. 1, 2004

(30) Foreign Application Priority Data

Dec. 22, 2000 (SE) ..... 0004835

(51) Int. Cl.[7] ..... H01Q 1/38

(52) U.S. Cl. ..... 343/700 MS; 343/853; 333/117

(58) Field of Search ..... 343/700 MS, 850, 343/853; 333/116, 117, 238, 246, 26

(56) References Cited

U.S. PATENT DOCUMENTS

| | | | | | |
|---|---|---|---|---|---|
| 4,636,754 | A | * | 1/1987 | Presser et al. | 333/116 |
| 4,937,541 | A | * | 6/1990 | Podell et al. | 333/116 |
| 5,521,563 | A | * | 5/1996 | Mazzochette | 333/116 |
| 5,834,991 | A | * | 11/1998 | Mazzochette | 333/116 |
| 6,147,570 | A | * | 11/2000 | Gill | 333/116 |
| 6,636,126 | B1 | * | 10/2003 | Pozdeev | 333/117 |
| 6,778,037 | B1 | * | 8/2004 | Salmela et al. | 333/109 |

FOREIGN PATENT DOCUMENTS

| | | | |
|---|---|---|---|
| JP | 56110303 A | 9/1981 | H01P/5/16 |
| JP | 5335817 A | 12/1993 | H01P/5/18 |
| WO | WO97/19485 | 5/1997 | H01P/5/18 |

* cited by examiner

*Primary Examiner*—Hoang V. Nguyen
(74) *Attorney, Agent, or Firm*—Jacobson Holman PLLC

(57) ABSTRACT

A four port hybrid microstrip circuit of modified Lange type, comprising a microstrip pattern including a first strip conductor between an input port (P1) and a direct port (P2) and a second strip conductor between an isolated port (P3) and a coupled port (P4). These two conductors are divided into parallel sections being mutually interdigitated and divided ibnto two parts (10,20) located side by side to each other.

11 Claims, 3 Drawing Sheets

FOUR PORT HYBRID MICROSTRIP CIRCUIT OF LANGE TYPE

FIELD OF THE INVENTION

The present invention relates to a four port hybrid microstrip circuit of modified Lange type, with a microstrip pattern having first and second strip conductors extending between an input port and a direct port and between an isolated port and a coupled port, respectively. More particularly, the microstrip circuit is of the kind defined in the preamble of claim 1.

BACKGROUNTD OF THE INVENTION AND RELATED ART

Lange couplers are generally used to couple electromagnetic energy between transmission lines. In a four port hybrid, there is an input port and a direct port, these two ports being directly and conductively connected to each other, as well as a coupled port, the latter being connected to transmission lines coupled electromagneticly (inductively and capacitively) to the conductors extending between the input and direct ports. Such hybrid couplers are used extensively as essential components in balanced circuits, such as balanced amplifiers.

In a Lange type coupler, each strip conductor is divided into mutually parallel sections, and the conductor sections from the two different strip conductors are interdigitated, so that each strip section is located between two sections from the other conductor. In a planar arrangement, it is necessary to have cross-over connectors in order to establish a direct conductive connection between the various sections extending in parallel.

A four port hybrid microstrip circuit of this kind is disclosed in U.S. Pat. No. 4,937,541 (Pacific Monolithics). The device has a reduced size and improved performance being obtained by capacitors added between the input and coupled ports and between the direct and isolated ports. Moreover, the known device is designed for R frequencies in the order of 10 GHz.

The present invention also aims at obtaining a reduced size o: the circuit, in particular for much lower frequencies in the range 0.5 to 5.0 GHz, in particular in the frequency range used for wireless communication systems.

However, when trying to obtain a satisfactory coupling, normally 3 dB, the strip conductors and the gaps between them become very narrow. With associated degradation of microstrip line Q factor and a high insertion loss. Therefore, it is difficult to use standard methods, especially production methods based on PCB technology.

SUMMARY OF THE INVENTION

Accordingly, the main object of the invention is to reduce the problems indicated above and to provide a circuit structure which enables the use of standard technology for producing a microstrip circuit which is operative even in relatively low frequency bands.

This object is obtained for a microstrip circuit of the kind referred to in the coning paragraph, where the strip conductor sections of the first and second strip conductors are divided into first and second parts extending longitudinally in opposite directions side by side, the parallel conductor sections of each strip conduct or in the first part being joined to a first and a second junction strip section, respectively, leading sideways to the associated parallel conductor sections in the second part. Preferably, the cross-over connectors are constituted by standard microstrip technology components, such as zero ohm resistors.

By arranging the circuit in two parts side by side, the overall dimensions of the device can he reduced, and it is also possible to use relatively wide conductor strips with relatively wide gaps therebetween. As a consequence, the microstrip line Q factor will be high and the insertion loss will be low. Moreover, standard PCB technology for microstrip circuits can be used, and the cross-over connectors may be constituted by commercially available zero ohm resistors.

BRIEF DESCRIPTION OF THE DRAWINGS

The invention will now be described more fully with reference to the appended drawings illustrating a preferred embodiment.

BRIEF DESCRIPTION OF A PREFERRED EMBODIMENT

Figure 1:
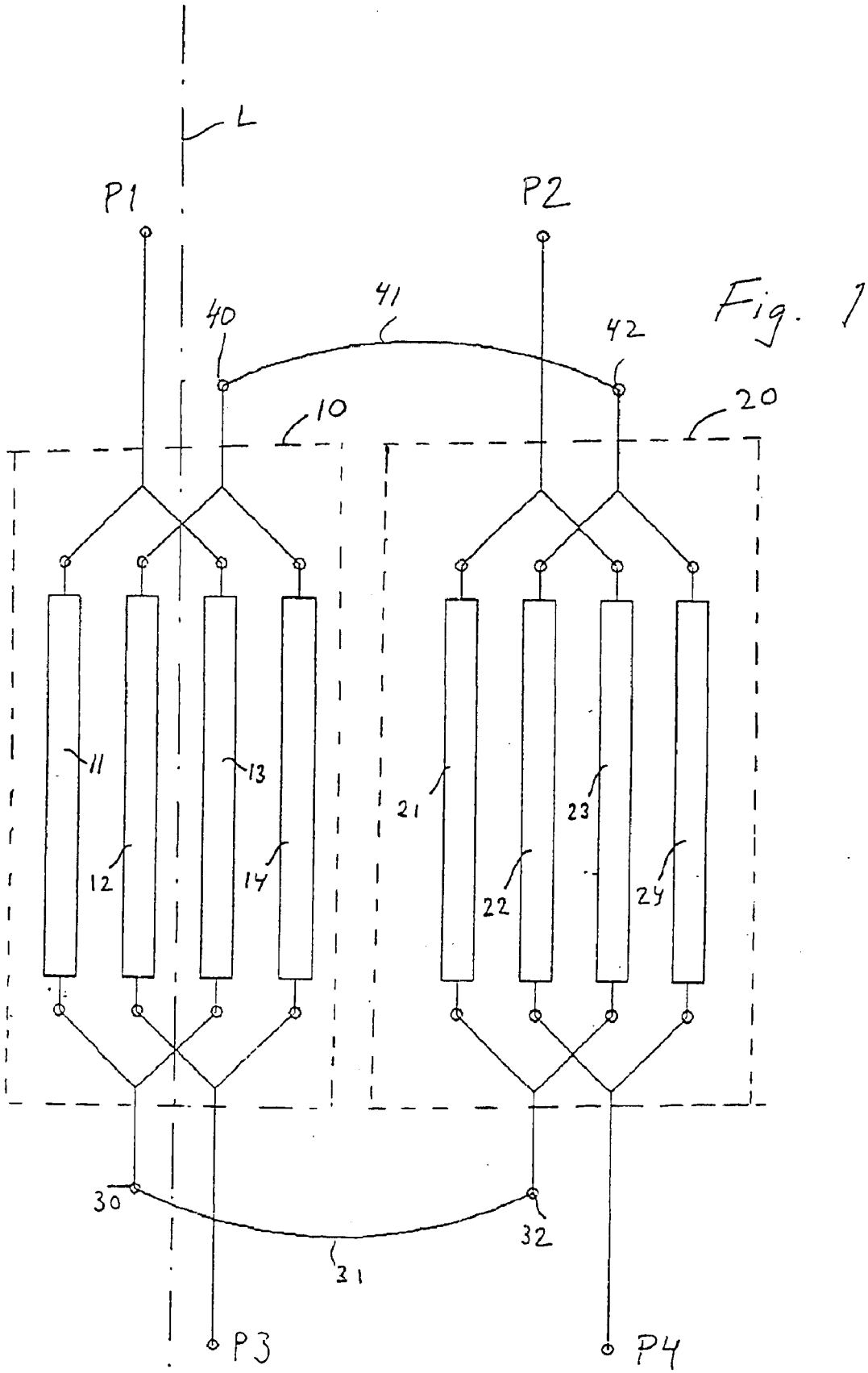
FIG. 1 illustrates schematically the interconnection of various strip conductor sections included in the hybrid microstrip circuit according to the invention.

FIG. 1 illustrates the basic arrangement of the strip conductors included in the four port hybrid microstrip circuit according to the invention. The four ports are denoted P1 to P4, where P1 is an input port and P2 is a direct port which is directly and conductively connected to the input port P1. The port P3 is an isolated port, whereas P4 is a coupled port, these two ports being directly and conductively connected to each other. A RF signal applied to the input port P1 will be conductively transmitted to the direct port P2 and, simultaneously, a part of the electromagnetic energy will be transferred, by way of electromagnetic coupling, to the coupled port P4.

According to the invention, the microstrip circuit includes two parts, viz. a first part generally denoted 10, and a second part, generally denoted 20. The two parts 10 and 20 are physically located side by side, but they are electrically connected in serious to one another.

Thus, the input port P1 is connected to two parallel conductor sections 11, 13 in the first circuit part 10, these two sections being jointly connected to a terminal 30. The terminal 30 is connected to a first junction strip section 31 leading sideways to another terminal 32. The terminal 32 is connected to two parallel strip conductor sections 21, 23 in second circuit part 20, these conductor sections 21 and 23 being jointly connected to the direct port P2. So, there is a continuos conductive path from the input port P1 to the direct port P2, having the general shape of the letter U and extending generally along the longitudinal direction L.

In a similar manner, the isolated port P3 is connected to two parallel conductor sections 12 and 14, which are jointly connected to a terminal 40. The terminal 40 is connected by a second junction strip section 41 leading sideways to a terminal 42, which in turn is connected to two parallel conductor sections 22 and 24 in the second circuit part 20. These conductor sections 22 and 24 are jointly connected to the coupled port P4. So, the ports P3 and P4 are connected conductively to each other by way of a conductive path which is also configured like the letter U.

By way of this general configuration, the overall dimensions of the device can be kept relatively small.

Figure 2:
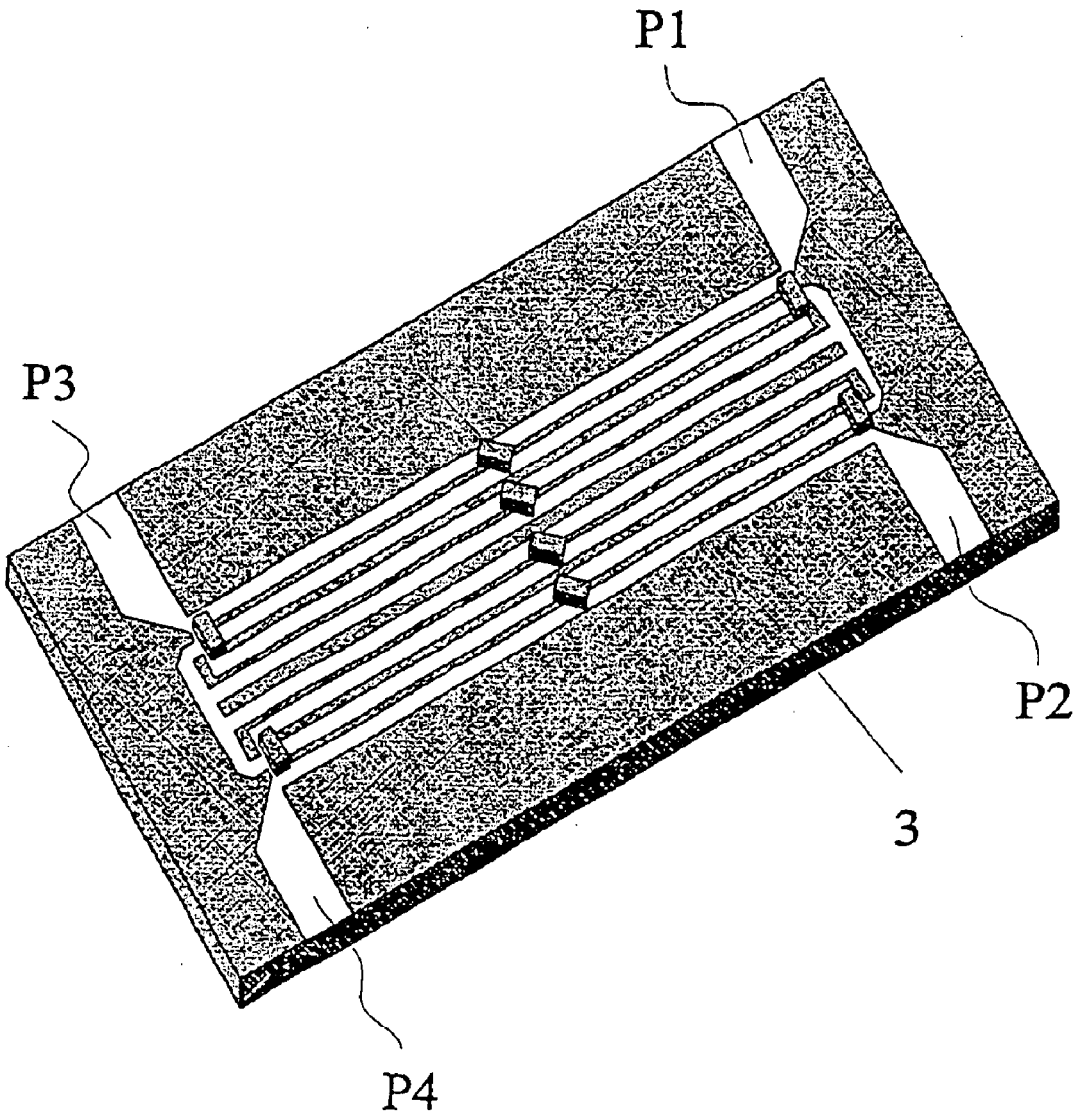
FIG. 2 shows in perspective view an implemented embodiment of the circuit according to the invention.
Figure 3:
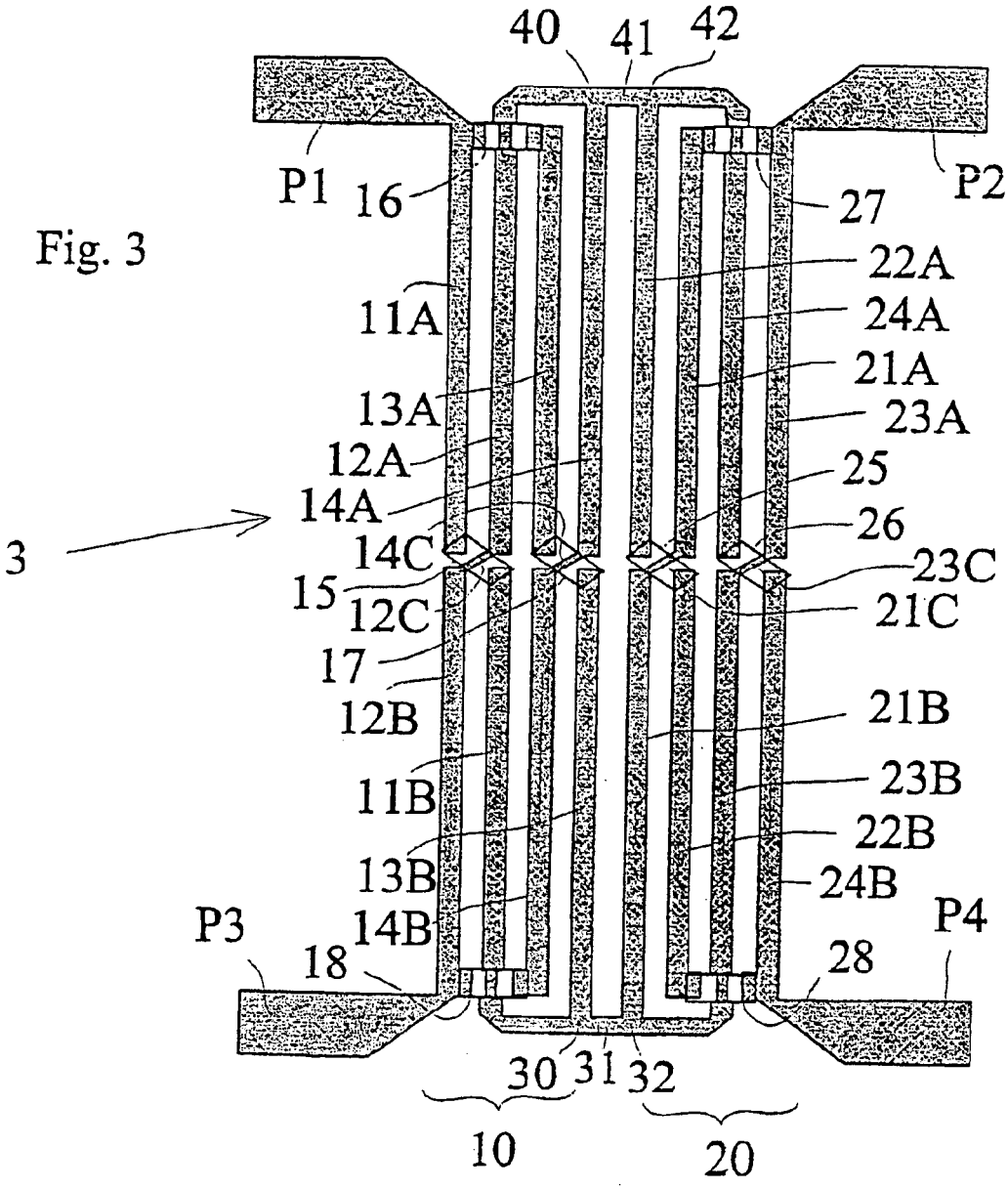
FIG. 3 shows a planar view o: the microstrip pattern in he device according to FIG. 2.
Figure 4:
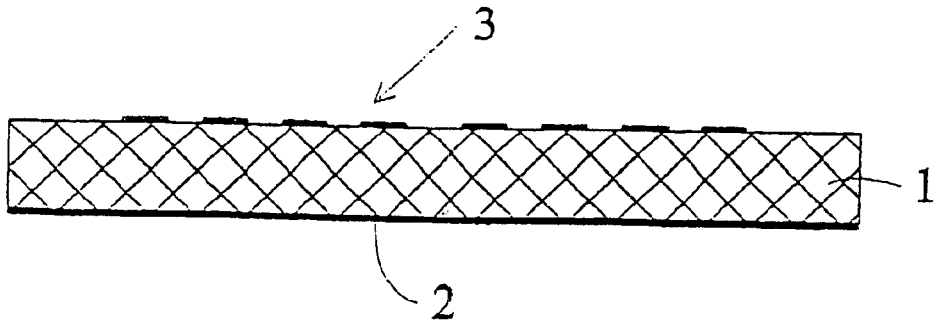
FIG. 4 is a cross section through the microstrip circuit shown in FIGS. 2 and 3.

A practical embodiment implementing the general structure shown in FIG. 1 is shown in FIGS. 2, 3 and 4.

The hybrid microstrip circuit is arranged on a planar, generally rectangular substrate 1 of a dielectric material of the kind DICLAD 527, a commercially available product obtainable from Arlon. This material has a permittivity of 2.55, and the thickness of the dielectric substrate is 0.76 mm in the preferred embodiment.

On a first surface of the substrate 1 (the lower side in FIG. 4), there is a ground plane layer 2 constituted by a thin metal layer, in the preferred embodiment of Cu, haling a thickness of 0.035 mm. On a second surface opposite to the first surface (the upper side in FIG. 4), there is a microstrip pattern 3 implementing the general structure shown in FIG. 1.

However, in the practical embodiment, as illustrated most clearly in FIG. 3, the strip conductors are arranged in a slightly modified manner in order to minimise the number of crossing conductor sections.

The pattern 3 is obtained e.g. by printing or etching a thin metal layer, e.g. likewise of Cu with the same thickness as the ground plane layer 2, i.e. 0.035 mm.

The four ports P1, P2, P3 and P4 are constituted by terminal pads arranged in the four corners of the device.

As appears from FIG. 3, the first strip conductor connected to the input port P1 comprises a conductor section with two portions 11A and 11B (corresponding to section 11 in FIG. 1) and a parallel conductor section with two portions 13A and 13B (corresponding to the conductor section 13 in FIG. 1). The conductor section portion 11A is connected to the conductor section portion 11B by means of a diagonally extending crossover connector 15 in the form of a 0 ohm resistor of ordinary type.

The input port P1 is connected to the conductor section portion 13A by means of a transverse cross-over connector 16, and the conductor section portion 13A is connected to the connector section portion 133 by means of a diagonally extending cross-over connector 17. All these conductor section portions 11A, 11B, 13A, 13B belong to the first strip conductor in the first part 10 of the device.

The conductor section portions 11B and 13B are jointly connected to a terminal or point 30, which in turn is connected to the first junction strip section 31 leading sideways to the second part 20.

From the terminal or point 32, the first strip conductor has two parallel branches or conductor section portions 21B and 23B being connected respectively, by means of diagonally extending connecting sections 21C and 23C, to conductor section portions 21A and 23A, both being connected to the direct port P2. The conductor section portions 21A and 213 correspond to the conductor section 21 in FIG. 1, and the conductor section portion 23A and 23B correspond to the conductor 23 in FIG. 1. The conductor section portion 21A is connected to the direct port P2 by means of a transverse cross-over connector 27.

In a similar manner, the isolated port P3 and the coupled port P4 are connected by a second strip conductor having conductor section portions 12A, 12B and 14A, 14B in the first part 10, a second junction strip section 41 between the terminals 40 and 42 of the first and second circuit parts 10, 20, respectively, and mutually parallel conductor section portions 22A, 22B and 24A, 24B.

The conductor section portions 12A, 12B are connected by a diagonally extending conductor section 12C, and the conductor section portions 14A and 14B are connected by a diagonally extending conductor section 14C. The conductor sections 22A and 22B are connected by a diagonally extending cross-over connector 25, and the conductor section portions 24A, 24B are connected by a diagonally extending cross-over connector 26. The isolated port P3 is connected to the conductor section portion 145 by a transverse connector 18, and the coupled port P4 is connected to the connector section portion 223 by a transverse connector 28.

The connectors 16-18 and 25-28 are all of the same kind as the connector 15.

As known per se, there will be a strong electromagnetic coupling between the parallel conductor sections belonging to the two different strip conductors, e.g. between the conductor sections 11A, 11B, 13A, 13B, on one hand, and the conductor sections 12A, 12B, 14A, 14B, on the other hand (in the first part 10 of the circuit device). Accordingly, an input signal applied to the input port P1 will be divided into a first signal component appearing at the direct port P2, and a second signal component appearing at the coupled port P4. These two signal components have generally the same energy content and amplitude, provided that the coupling is effectively 3 dB. In order to achieve such an effective coupling, the length of the conductor sections 11A, 11B, etc, and thus of the longer side of the rectangular configuration of the whole circuit, should be a quarter wavelength or, generally, N/4 of a wavelength, N being an odd integer.

The signal components appearing at the direct and coupled ports P2 and P4 are mutually phase shifted 90°.

With the structure of the microstrip pattern shown in FIG. 3, it has turned out that such a coupling is achieved in the RF frequency range normally used in mobile telephone communication systems, in spite of the fact that the strip conductor sections are relatively wide, 0.3-0.7 mm, preferably about 0.5 mm, and have corresponding gaps between them, likewise 0.3-0.7 mm, preferably about 0.5 mm, whereby the circuit can be produced by normal methods used in ordinary PCB technology, including the cross-over connectors or jumpers 15-18 and 25-28.

The illustrated embodiment may be modified within the scope of the claims. For example, each strip conductor may comprise three or more parallel sections in each part 10, 20. Also, if desired, it is possible to use very narrow strip conductors and gaps therebetween (as narrow as in conventional Lange couplers) and thereby achieve an even tighter coupling factor, such as 1 dB instead of 3 dB.

What is claimed is:

1. A four port hybrid microstrip circuit of modified Lange type, comprising a substantially planar dielectric substrate (1) having first and second surfaces located in opposite relation to each other, a ground plane layer (2) of conducting material on said first surface, a microstrip pattern (3) of conducting material on said second surface, said microstrip pattern including a first strip conductor (11, 13, 31, 21, 23) extending between an input port (P1) and a direct port (P2) and a second strip conductor (12, 14, 41, 22, 24) extending between an isolated port (P3) and a coupled port (P4).

said first and second strip conductors having mutually parallel conductor sections extending along a longitudinal direction (L), the conductor sections of the first strip conductor being situated in close vicinity to the conductor sections of the second strip conductor so as to couple electromagnetic energy from said first strip conductor to said second strip conductor and to divide a RF signal applied to said input port (P1) to said direct and coupled ports (P2, P4), cross-over connectors (15-18, 25-28) being mounted onto said parallel strip conductors in order to establish a direct conductive connection between various portions of said sections belonging to said first strip conductor and to said second strip conductor, respectively, Characterized in that the strip conductor sections of said first and second strip conductors are divided into first and second parts (10, 20) extending in opposite directions side by side in parallel to said longitudinal direction (L), said parallel conductor sections of each strip conductor in said first part (10) being joined to a first and a second junction strip section (31, 41), respectively, leading sideways to the associated parallel conductor sections in the second part (20), and each of said first and second parts (10, 20) comprising at least two parallel conductor sections (11, 13; 21, 23) belonging to said first strip conductor and at least two conductor sections (12, 14; 22, 24) belonging to said second strip conductor.

2. The hybrid circuit defined in claim 1, wherein said crossover connectors (15-18, 25-28) are constituted by standard microstrip technology components.

3. The hybrid circuit defined in claim 2, wherein said crossover connectors are zero ohm resistors.

4. The hybrid circuit defined in claim 1, wherein each of said parallel sections is divided longitudinally into two portions (11A, 11B, 13A, 13B, 21A, 23B) being connected to each other by pairwise diagonally crossing connecting sections (12C, 14C, etc) and cross-over connectors (15, 17, etc).

5. The hybrid circuit defined in claim 1, wherein one end of said first strip conductor sections (11, 13) in said first part (10) are jointly connected to said input port (P1) and the other end of these first strip conductor sections are jointly connected to said first junction strip section (31), and one end of said first strip conductor sections (21, 23) in said second part (20) are jointly connected to said first junction strip section (31) and the other end of these first strip conductor sections are jointly connected to said direct port (P2), whereas one and of said second strip conductor sections (12, 14) in said first part (10) are jointly connected to said isolated port (P3) and the other end of these second strip conductor sections are jointly connected to said second junction strip section (41), and one end of said second strip conductor sections (22, 24) in said second part (20) are jointly connected to said second junction strip section (41) and the other end of these second strip conductor sections are jointly connected to said coupled port (P4).

6. The hybrid circuit defined in claim 4, wherein said first junction strip section (31) extends sideways in a region between said isolated port (P3) and said coupled port (P4), whereas said second junction strip section (41) extends sideways in a region between said input port (P1) and said direct port (P2).

7. The hybrid circuit defined in claim 1, wherein said first and second parts (10, 20) of the circuit are confined in a rectangular region with the four ports located in the four corners thereof.

8. The hybrid circuit defined in claim 7, wherein the length of said rectangular region in said longitudinal direction is approximately N/4 of a wavelength of said RF signal, N being an odd integer.

9. The hybrid circuit defined in claim 1, wherein the circuit is operable for RF signals in at least one microwave frequency band in the frequency range 0.5 to 5.0 GHz.

10. The hybrid circuit defined in claim 9, wherein the thickness of said dielectric substrate is 0.5-1.0 mm.

11. The hybrid circuit defined in claim 10, wherein the width of said strip conductor sections are 0.3-0.7 mm, the gaps between neighbouring strip conductor sections belonging to said first and second strip conductors being likewise 0.3-0.7 mm.

* * * * *